US006059602A

United States Patent [19]

Ward

[11] Patent Number: 6,059,602

[45] Date of Patent: May 9, 2000

[54] SHROUD FOR ELECTRICAL CONNECTOR

[75] Inventor: Bobby Gene Ward, King, N.C.

[73] Assignee: The Whitaker Corporation, Wilmington, Del.

[21] Appl. No.: 09/270,698

[22] Filed: Mar. 17, 1999

[51] Int. Cl.[7] ..... H01R 13/58

[52] U.S. Cl. ..... 439/465

[58] Field of Search ..... 439/465, 467, 439/470, 752

[56] References Cited

U.S. PATENT DOCUMENTS 3,569,900 3/1971 Uberbacher ..... 339/14
5,037,336 8/1991 Betsui ..... 439/752
5,048,715 9/1991 Wolff ..... 220/335
5,788,534 8/1998 Koegel et al. ..... 439/465

*Primary Examiner*—Lincoln Donovan
*Assistant Examiner*—Chandrika Prasad
*Attorney, Agent, or Firm*—Bradley N. Ditty

[57] ABSTRACT

An electrical connector assembly is provided having a plurality of terminal receiving cavities for housing a plurality of terminals connected to conductors. The terminals are held in the cavities by primary latches which are reinforced by projections on a shroud which extend behind the primary latches. The shroud provides wire dressing and strain relief for the conductors while providing a terminal position assurance function and secondary locking for the terminals.

22 Claims, 5 Drawing Sheets

SHROUD FOR ELECTRICAL CONNECTOR

FIELD OF THE INVENTION

The present invention is directed toward shroud members for attachment over a plurality of conductors which are connected to electrical terminals housed in a connector housing.

BACKGROUND OF THE INVENTION

Connector housings which carry a plurality of electrical terminals in respective terminal receiving cavities have numerous discrete wires which exit from an end of the connector housing. Within the housing, each wire is terminated to a respective electrical terminal. When installing these connector housings and wire assemblies in an end product, such as an automobile or an appliance, frequently these discrete wires can become snagged or tangled because of the disorganized condition of the wires exiting the connector housing. In order to prevent individual wires from snagging during installation, and thus reduce the potential for disconnections of the wires from their respective electrical terminals, electrical connector manufacturers have commonly utilized wire dressing techniques, including the use of shrouds which collect and organize the individual wires exiting the connector housing.

Another problem associated with snagging of wires, either individually or collectively, is that the electrical terminals connected to those wires may become dislodged or completely removed from their respective terminal receiving cavity. If this occurs and the terminal is not properly seated within its terminal receiving cavity, when the connector housing is connected with a mating connector, the electrical integrity of the connection may be compromised. To address this problem, electrical connector manufacturers frequently design connector housings which contain locking members that are intended to retain the terminals within their cavities. In addition, secondary locking devices are used in combination with such locking members to provide further assurance that terminals will not be inadvertently extracted from their cavities. These secondary locking devices are usually separate members which are inserted into the connector housing and around the terminal cavities and their associated locking members. Generally, the secondary locking device acts as a back-up to primary locking members. The secondary locking devices typically reside within the connector housing, thus increasing the overall size of the connector housing and increasing the complexity of the connector, thereby making assembly more difficult.

In addition to secondary locks, true position assurance devices (TPAs) are frequently employed to ensure that terminals are fully inserted into their terminal receiving cavities and are, therefore, correctly positioned for locking within the connector housing. TPAs most commonly function by urging terminals which are not completely inserted into their terminal receiving cavity into proper position within the connector housing.

Often, a shroud and separate secondary locking and TPA devices are employed in order to reduce the likelihood of displaced terminals and snagged conductors. Used in combination, these devices provide terminal position assurance, terminal locking, wire dressing and strain relief for the conductors which are exiting the connector housing.

Because size constraints, ease of manufacturability, and cost are all primary concerns in connector manufacturing, it would be desirable to provide a connector which includes a connector housing that has terminal position assurance, a wire dressing shroud and strain relief capabilities, while satisfying the foregoing concerns.

SUMMARY OF THE INVENTION

Accordingly, it is an object of the present invention to provide a shroud which provides terminal position assurance, secondary locking, wire dressing of multiple conductors exiting a connector housing, and strain relief for those conductors. To that end, a shroud is provided for attachment to a connector housing which carries a plurality of electrical terminals within respective electrical terminal receiving cavities, the shroud comprising a top shell engaged with a complementary bottom shell. The top shell and the bottom shell have a forward opening opposite a rear opening. The top shell and the bottom shell further have an inner surface extending from the forward opening to the rear opening and facing an interior. A lip is provided about the front opening of the shroud for attachment to the connector housing. Locking fingers are disposed along the inner surface proximate the front opening and extend into the terminal receiving cavities behind electrical terminals to secure them within the connector housing.

An electrical connector assembly is further provided having a connector housing with a plurality of terminal receiving cavities for receiving a plurality of electrical terminals terminated to conductors. The terminal receiving cavities open at a back end of the connector housing. A shroud is provided for attachment to the back end of the connector housing. The shroud has a top shell attached to a complementary bottom shell and the top and bottom shell both have an inner surface facing an interior. Opposing side walls are disposed perpendicularly to the top shell and the bottom shell and extend from a forward opening to a rear opening. Projections are formed on the inner surface of at least one of the top shell or the bottom shell proximate the forward opening. The projections extend beyond the forward opening and into the terminal receiving cavities of the connector housing.

DESCRIPTION OF THE DRAWINGS

Embodiments of the present invention will now be described by way of example with reference to the accompanying drawings, in which.

DETAILED DESCRIPTION OF THE INVENTION

Figure 1:
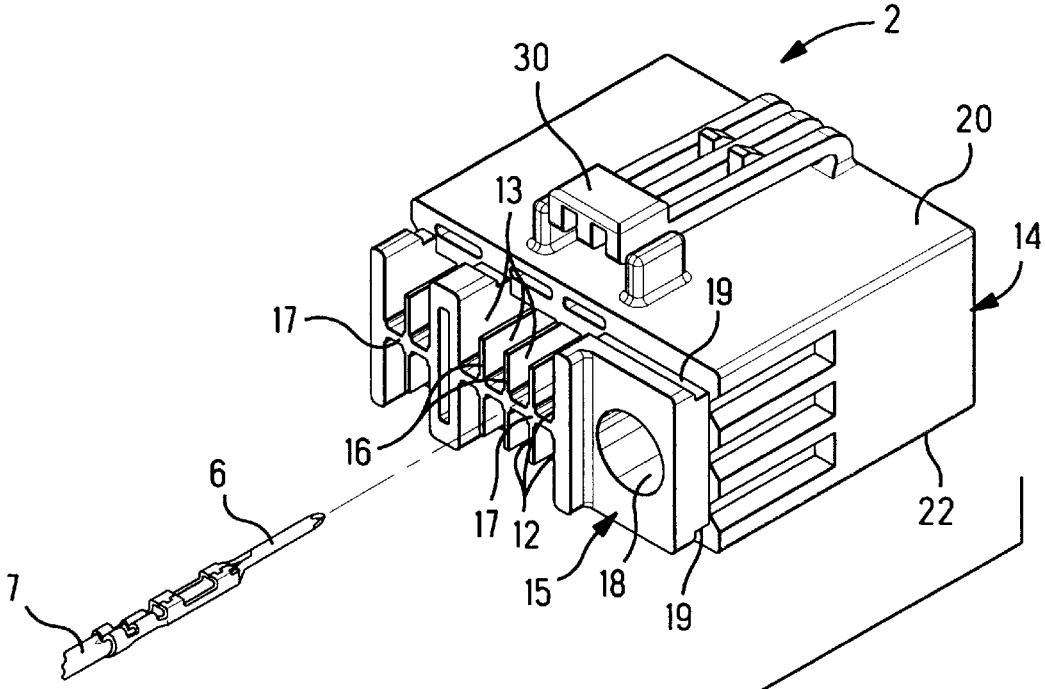
FIG. 1 is an isometric view of the connector housing and an electrical terminal of the present invention.

FIG. 1 shows a plug 2 having two rows of terminal cavities 12 which receive electrical terminals 6 terminated to conductors 7. The plug 2 has a mating face 14 opposite a back end 15. Each terminal cavity 12 has a rear opening 13 for receiving conductors 7 and their respective terminals through the back end 15 of the plug 2. The terminal cavities 12 and their respective rear openings 13 are divided by vertical walls 16 and horizontal walls 17. Adjacent the rows of terminal cavities 12 and rear openings 13 is a coaxial terminal cavity opening 18. Back end 15 has an interrupted groove 19 located on top and bottom surfaces 20 and 22 proximate the back end 15 of the plug 2. A latch member 30 is disposed on top surface 20 for latching with a complementary connector (not shown).

Figure 2:
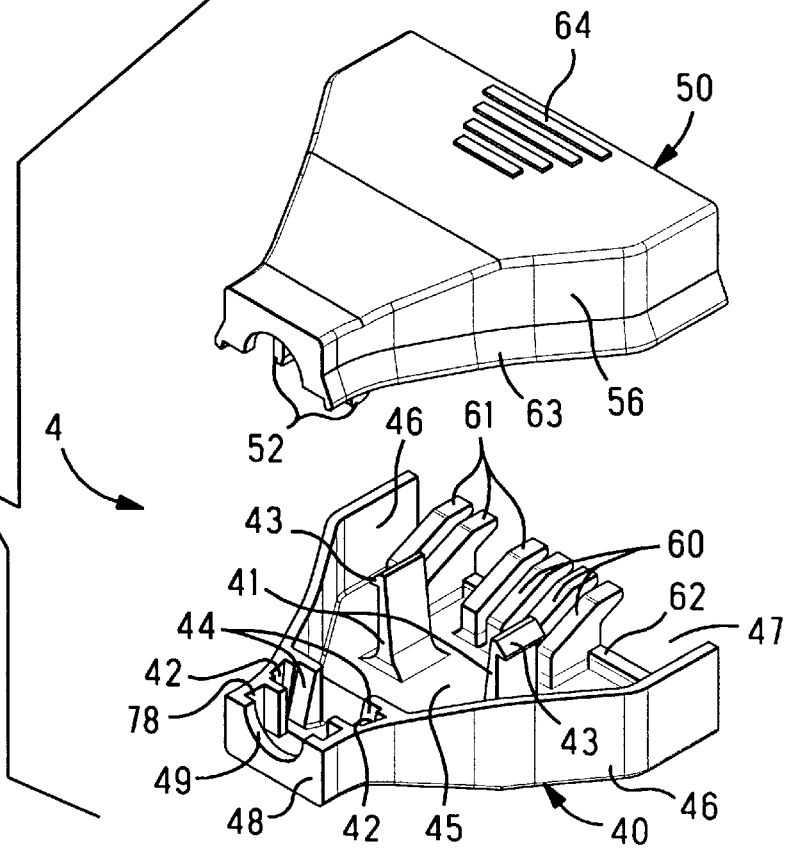
FIG. 2 is an exploded isometric view of the shroud member of the present invention.

FIG. 2 shows an embodiment of the strain relief member of the present invention. Strain relief member 4 is shown having a bottom shell 40 and a top shell 50. Bottom shell 40 has an interior major surface 45 bordered by perpendicular sidewalls 46 that neck down from a wide forward opening 47 to a narrow exit portion 48. A semi-circular opening 49 is provided in exit portion 48 to allow passage of a plurality of conductors or a cord (not shown). Perpendicular latch arms 41 extend upwardly from interior major surface 45 and have tapered projections 43 to facilitate latching to top shell 50.

A row of secondary locking projections 60 extends perpendicularly from interior major surface 45 and projects forwardly beyond forward opening 47. Running the length of interior major surface 45 between perpendicular sidewalls 46 is lip 62 which is disposed proximate forward opening 47 and interrupted by secondary locking projections 60. Lip 62 is dimensioned such that it is complementary to interrupted groove 19 located on plug 2.

Figure 3:
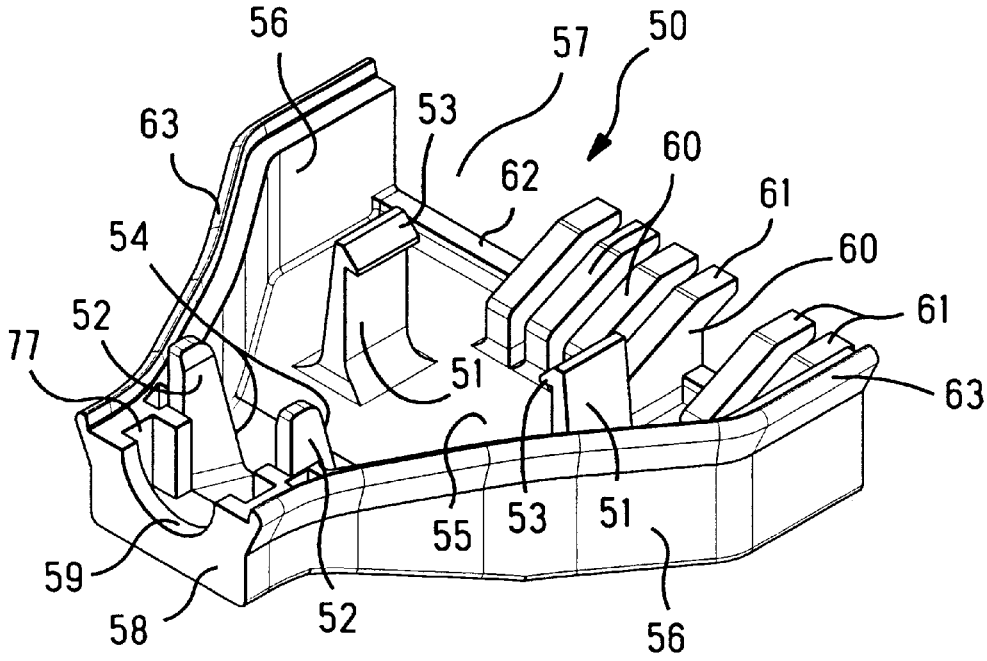
FIG. 3 is an isometric view of the top shell member also shown in FIG. 2.
Figure 4:
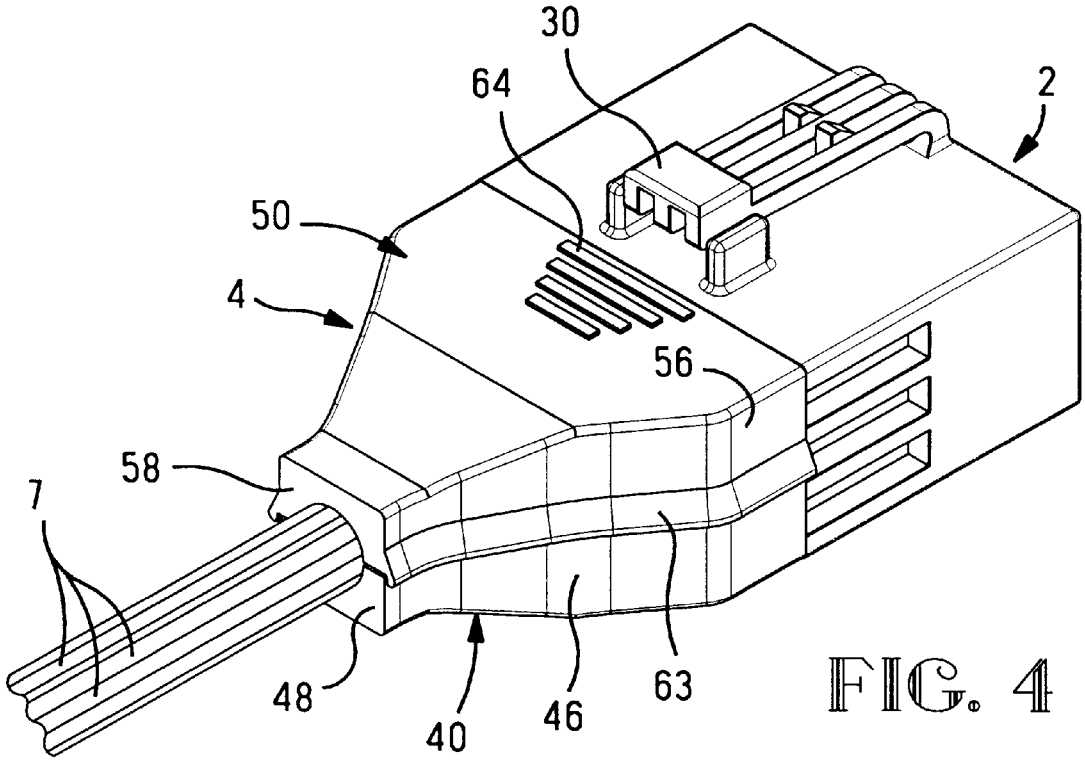
FIG. 4 is an isometric view of the assembled connector housing and shroud member of the present invention.

As shown in FIGS. 2 and 3, top shell 50 has a similar shape to bottom shell 40 including a forward opening 57 and an exit portion 58. Perpendicular sidewalls 56 extend from interior major surface 55 to a flared rim 63 which overlaps perpendicular sidewalls 46 of bottom shell 40 upon assembly (also shown in FIG. 4). Semi-circular opening 59 complements semi-circular opening 49 of bottom shell 40 to allow passage of a cord or plurality of conductors 7, as shown in FIG. 4. Guide posts 52 extend from interior major surface 55 proximate exit portion 58 and are received in guide slots 42, of bottom shell 40 upon assembly. An embodiment of the guide posts 52 and guide slots 42, best shown in FIG. 5, have complementary tapered guide surfaces 44 and 54. Complementary latch arms 51 are disposed on interior major surface 55 to engage perpendicular latch arms 41 upon assembly. Tapered projections 53 are disposed at the ends of complementary latch arms 51 and engage tapered projections 43 of perpendicular latch arms 41. As with bottom shell 40, top shell 50 has a row of secondary locking projections 60 and a lip 62.

Figure 5:
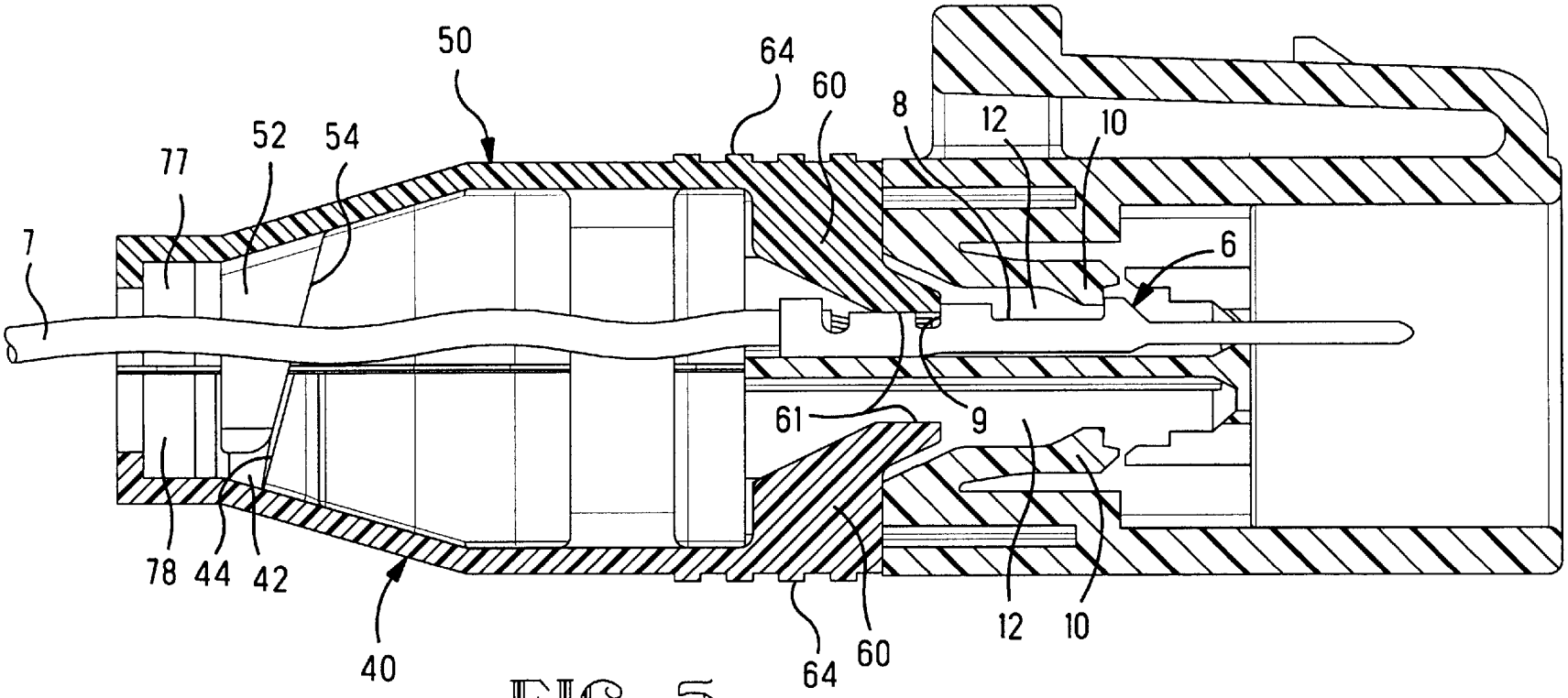
FIG. 5 is a cross sectional side view of the assembled connector housing and shroud member of the present invention.
Figure 6:
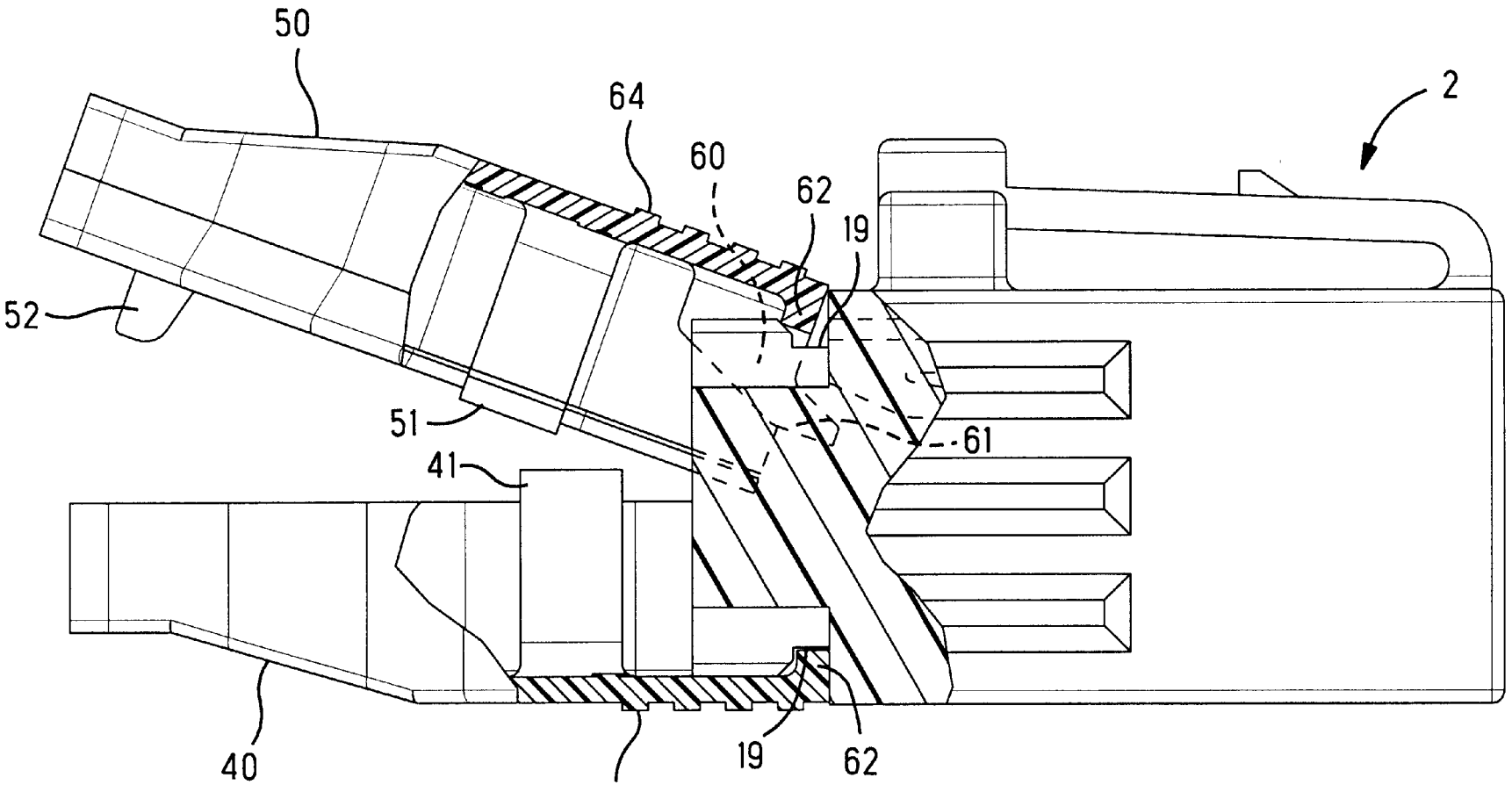
FIG. 6 is a side view of the connector housing and shroud member of the present invention with a cut-away showing attachment of the shroud to the connector housing.

FIG. 4 shows an isometric view of an embodiment of the present invention in a fully assembled condition. Plug 2 has been loaded with electrical terminals (not shown) connected to conductors 7. The conductors 7 are gathered at back end 15 of plug 2 where strain relief member 4 is assembled over the conductors to provide wire dressing and strain relief. FIG. 6 shows an embodiment of the present invention wherein lip 62 cooperates with interrupted groove 19 to function as a camming bar and a camming slot, respectively. That is, the top and bottom shell may be attached to plug 2 by inserting lip 62 into interrupted groove 19 at an angle and pivoting the shell inwardly about the lip 62. This pivoting action provides a mechanical advantage for urging partially seated electrical contacts (not shown) forward into a fully seated position in the terminal cavities, as shown in FIG. 5. Bottom shell 40 and top shell 50 of strain relief member 4 are guided into engagement by way of guide posts 52 and guide slots 42, shown in FIG. 2. Bottom and top shells 40 and 50 are then snapped into engagement by perpendicular latch arms 41 and complementary latch arms 51. Upon full assembly, strain relief member 4 is secured to plug 2 by way of lip 62 which is fitted within interrupted groove 19.

As shown in FIG. 5, secondary locking projections 60 have nose portions 61 which extend into terminal cavities 12 behind primary terminal latches 10. As further shown in FIG. 5, electrical terminals 6 have primary latch holes 8 which receive primary terminal latches 10 upon full insertion of electrical terminal 6. Terminal edge 9 is disposed behind primary latch hole 8 providing a shoulder for receiving nose portion 61 of secondary locking projection 60 which thereby provides secondary locking of electrical terminal 6 within terminal cavity 12.

During loading of electrical terminals 6 into plug 2, occasionally terminals are not fully loaded and properly latched by primary terminal latches 10. One advantage of the present invention is that when terminals are not fully inserted into terminal cavities 12, nose portions 61 of secondary locking projection 60 engage terminal edges 9 when assembling strain relief member 4 onto plug 2. This drives electrical terminal 6 forward into terminal cavities 12, thereby ensuring that primary terminal latches 10 engage primary latch holes 8, thus securing the terminals within the cavities. This function of strain relief member 4 provides terminal position assurance by ensuring that terminals are fully inserted into plug 2 before the plug and strain relief assembly is mated to a complementary connector (not shown).

Another advantage of the present invention is that secondary locking is provided for the electrical terminals. In the event that forces are exerted upon the conductors which are connected to the electrical terminals, stress is placed on primary terminal latches 10 occasionally causing primary terminal latches 10 to break. Because of the positioning of nose portions 61 of secondary locking projections 60, primary terminal latches 10 are backed up by nose portion 61 thereby strengthening primary terminal latch 10 and reducing the likelihood of damage to the latch and extraction of the electrical terminal.

A further advantage is achieved by exit portions 48 and 58 in cooperation with semi-circular openings 49 and 59 of strain relief member 4. Exit portions 48 and 58 and semi-circular openings 49 and 59 provide strain relief for conductors 7 by collecting and gripping the conductors 7 as they exit the strain relief member. Furthermore, the strain relief member 4 provides a wire dressing function by gathering the individual conductors 7 exiting the back end 15 of plug 2 and directing them into one group of conductors 7 shown in FIG. 4 exiting the strain relief member 4.

Figure 7:
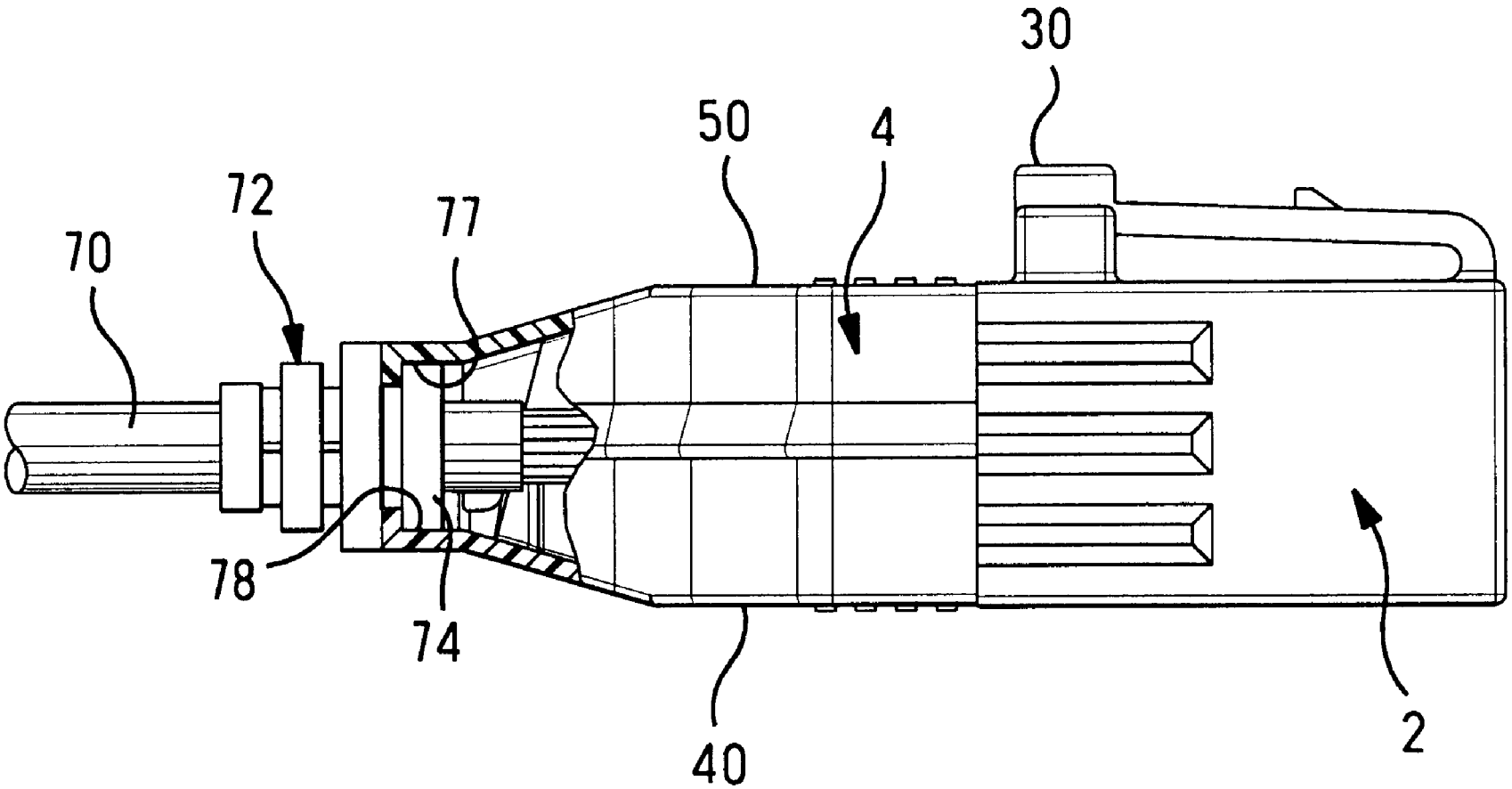
FIG. 7 is a side view of the assembled connector housing and shroud member of the present invention with a cut-away showing a strain relief member disposed in a recess of the shroud member.

It should be apparent that the individual conductors 7 may be substituted by a single cord which carries the individual conductors. Furthermore, top shell 50 and bottom shell 40 are molded to accommodate a cord 70 having an integrally molded strain relief portion 72, as shown in FIG. 7. Strain relief portion 72 has a molded rubber grommet 74 which is received in grommet recess 77 and 78 of the top shell and bottom shell, respectively.

A further advantage is achieved by providing a strain relief member 4 which is firmly secured to plug 2 by way of lips 62 cooperating with interrupted grooves 19. Because the strain relief member 4 is firmly secured onto plug 2, latch member 30 may be actuated and gripping features 64 located on the exterior of strain relief member 4 may be grasped by hand to remove the plug 2 and strain relief member 4 from a complementary connector (not shown).

A further advantage is provided by the secondary locking projections of the present invention in that each conductor and its respective terminal is physically and electrically isolated from an adjacent conductor and terminal. This physical and electrical isolation is provided by way of secondary locking projections 60 extending into the rear openings 13 of terminal cavities 12. Secondary locking projections 60, therefore, provide a fourth wall to the trough-shaped rear openings defined by vertical walls 16 and horizontal walls 17 to completely isolate each terminal cavity.

It should be apparent that modifications may be made to the present invention to accommodate different designs of the plug assembly. For instance, a strain relief member may be provided having secondary locking projections on only one of the top or bottom shell. Similarly, secondary locking projections 60 may be tailored appropriately to cooperate with various shapes of primary terminal latches 10. For example, nose portion 61 may extend further into terminal cavities 12. Of course, the overall shape of strain relief member 4 may be altered to accommodate different sizes or numbers of conductors. Furthermore, various latching configurations could be implemented to attach the top and bottom shells together. Likewise, techniques such as heat staking, using adhesives, or employing ultrasonic technology may be utilized to attach the top and bottom shells.

The strain relief member of the present invention and many of its attendant advantages will be understood from the foregoing description. It is apparent that changes may be made in the form, construction and arrangement of parts thereof without departing from the spirit of the invention, or sacrificing all of its material advantages. Thus, while embodiments of the invention have been disclosed it is to be understood that the invention is not strictly limited to those embodiments but may be otherwise variously embodied and practiced within the scope of the appended claims.

I claim:

1. A shroud for attachment to an electrical connector housing which carries a plurality of electrical terminals within terminal receiving cavities, the shroud comprising:

a top shell attached to a bottom shell, the top shell and bottom shell each having opposing inner surfaces facing an interior bound by side walls which extend from a forward opening to a rear opening; and a plurality of projections disposed on at least one inner surface of the top shell or the bottom shell and which project forwardly from the forward opening into the terminal receiving cavities.

2. The shroud of claim 1, wherein the top shell and the bottom shell have a raised surface proximate the forward opening for engagement with a complementary recess disposed on the electrical connector housing.

3. The shroud of claim 1, wherein latch members extend from the inner surface of at least one of the bottom shell or top shell and engage latching shoulders disposed on the inner surface of the other bottom shell or top shell.

4. The shroud of claim 1, wherein at least one guide post is provided on the inner surface of one of the top shell or the bottom shell and is received in at least one guide slot disposed on the inner surface of the other top shell or bottom shell.

5. The shroud of claim 4, wherein the at least one guide post is tapered.

6. The shroud of claim 5, wherein the at least one guide slot has a tapered wall which is complementary to the at least one tapered guide post.

7. The shroud of claim 1, wherein the side walls of one of the top shell or bottom shell has a flared rim for engaging the side walls of the other of the top shell or bottom shell.

8. The shroud of claim 1, wherein the rear opening is fitted around a plurality of conductors attached to the plurality of electrical terminals, thereby providing strain relief of the plurality of conductors.

9. The shroud of claim 8, wherein the plurality of conductors are carried in the form of a cord.

10. The shroud of claim 9, wherein a strain relief member is provided on the cord and is retained in a recess disposed proximate the rear opening.

11. The shroud of claim 1, wherein the plurality of projections each has a nose portion which protrudes forwardly behind terminal latches located within the terminal receiving cavities.

12. An electrical connector assembly, comprising:

a connector housing having a plurality of terminal receiving cavities for receiving a plurality of electrical terminals terminated to conductors, the terminal receiving cavities opening at a back end of the connector housing; and a shroud for attachment to the back end of the connector housing, the shroud comprising:

a top shell attached to a bottom shell, the top shell and the bottom shell each having an inner surface facing an interior;

opposing side walls disposed perpendicularly to the top shell and the bottom shell and extending from a forward opening to a rear opening; and projections located on the inner surface of at least one of the top shell or the bottom shell, the projections disposed proximate the forward opening and extending beyond the forward opening into the terminal receiving cavities of the connector housing.

13. The electrical connector assembly of claim 12, wherein the top shell and the bottom shell have a lip along the forward opening for engagement with grooves on the back end of the connector housing.

14. The electrical connector assembly of claim 12, wherein one of the top shell and the connector housing has a lip for engaging a groove disposed on the other of the top shell and the connector housing.

15. The electrical connector assembly of claim 12, wherein one of the bottom shell and the connector housing has a lip for engaging a groove disposed on the other of the bottom shell and the connector housing.

16. The electrical connector assembly of claim 12, wherein the top shell has latching members which extend into the interior of the shroud and the bottom shell has complementary latching members which engage the latching members of the top shell.

17. The electrical connector assembly of claim 12, wherein one of the top shell or bottom shell has least one guide post which engages at least one guide slot disposed on the other of the top shell or bottom shell.

18. The electrical connector assembly of claim 15, wherein the at least one guide post is tapered and the at least one guide slot has a corresponding taper.

19. The electrical connector assembly of claim 12, wherein the side walls of one of the top shell or bottom shell has a flange to receive the side walls of the other of the top shell or bottom shell.

20. The electrical connector assembly of claim 12, wherein the plurality of conductors are carried in the form of a cord having a strain relief and wherein the strain relief is disposed within a recess disposed proximate the rear opening.

21. The electrical connector assembly of claim 12, wherein each of the projections has a nose portion which extends behind a terminal latch in the terminal receiving cavities.

22. A shroud for attachment to a connector housing wherein the connector housing carries a plurality of electrical terminals in a plurality of terminal cavities, the shroud comprising:

a shell having a front opening and a rear opening, wherein the front opening and the rear opening are joined by peripheral shell walls which define an interior of the shroud, the shell having an inner surface facing the interior of the shroud, the shell having at least one lip disposed proximate the front opening, the lip being attachable to the connector housing; and a plurality of locking members disposed on the inner surface proximate the front opening and which extend into terminal receiving cavities.

* * * * *